US007040272B2

(12) United States Patent
Kimura et al.

(10) Patent No.: US 7,040,272 B2
(45) Date of Patent: May 9, 2006

(54) MULTIPLE ELECTRONIC CONTROL THROTTLE BODY FOR OUTBOARD MOTOR

(75) Inventors: Jun Kimura, Kawasaki (JP); Makoto Sakai, Kawasaki (JP)

(73) Assignee: Keihin Corporation, Shinjuku-ku (JP)

( * ) Notice: Subject to any disclaimer, the term of this patent is extended or adjusted under 35 U.S.C. 154(b) by 0 days.

(21) Appl. No.: 11/119,619

(22) Filed: May 2, 2005

(65) Prior Publication Data

US 2005/0241615 A1 Nov. 3, 2005

(30) Foreign Application Priority Data

May 3, 2004 (JP) ..... 2004-143098

(51) Int. Cl.
*F02M 35/10* (2006.01)

(52) U.S. Cl. ..... 123/184.27; 123/336

(58) Field of Classification Search ..... 123/184.27, 123/184.37, 184.45, 184.52, 518, 399, 336
See application file for complete search history.

(56) References Cited

U.S. PATENT DOCUMENTS 1,970,025 A * 8/1934 Teeter ..... 123/184.45
2,230,740 A * 2/1941 Birkigt ..... 123/308
5,803,050 A * 9/1998 Osakabe et al. ..... 123/456
5,875,745 A * 3/1999 Watanabe et al. ..... 123/59.5
5,924,409 A * 7/1999 Kato ..... 123/463

FOREIGN PATENT DOCUMENTS

JP 8312485 * 11/1996
JP 2002-371865 12/2002

* cited by examiner

*Primary Examiner*—Mahmoud Gimie
(74) *Attorney, Agent, or Firm*—R. Neil Sudol; Henry D. Coleman; William J. Sapone

(57) ABSTRACT

A plurality of intake passages (2) provided in a horizontal direction in an electronically controlled throttle body (1) are arranged in a vertical direction. A throttle valve shaft (3) constituted by one shaft penetrates the intake passages (2) in a vertical direction. A gear receiving chamber (6) receiving gears (10, 14) and a motor receiving chamber (5) receiving a motor (12) are formed in an upper end portion (1*a*) of the throttle body (1). A vapor separator (20) is arranged in the throttle body (1) below the motor receiving chamber (5), while an axis (Y-Y) of an output shaft (12*a*) of the motor (12) and an axis (Z-Z) of a fuel pump (24) are arranged in parallel to an axis (X-X) of the throttle valve shaft (3).

3 Claims, 3 Drawing Sheets

MULTIPLE ELECTRONIC CONTROL THROTTLE BODY FOR OUTBOARD MOTOR

TECHNICAL FIELD

The present invention relates to a multiple throttle body for a fuel injection apparatus in which a plurality of intake passages provided through in a horizontal direction are arranged in a vertical direction, an opening area of each of the intake passages is controlled by a throttle valve attached to a throttle valve shaft arranged in the intake passage, whereby air flowing toward each of cylinders in an engine is controlled, and controlled fuel is injected and supplied toward each of the cylinders in the engine from each of fuel injection valves, and more particularly to a multiple electronic control throttle body used for the outboard engine and having a throttle valve electrically driven by a motor.

BACKGROUND ART

As a prior art of a multiple electronic control throttle body for an outboard motor, there has been Japanese Unexamined Patent Publication No. 2002-371865 filed by the applicant of the present invention.

In accordance with this structure, a plurality of intake passages provided through in a sideward direction are arranged in a vertical direction, respective throttle valve shafts are arranged in the respective intake passages transversely, and respective throttle valves opening and closing the respective intake passages are attached to the respective throttle valve shafts.

Further, a throttle body with which an adjusting screw is engaged is firmly fixed to each of the throttle valve shafts, and a worm lever provided with a worm gear on an outer periphery and a locking lever is arranged in a loosely fitting manner in each of the throttle valve shafts.

Further, the worm shaft is arranged so as to be rotatable and movable in a vertical direction, the motor is connected to an upper end of the worm shaft, and the worm gear in each of the worm levers is arranged so as to be engaged with the worm shaft.

In accordance with the structure mentioned above, when the motor is rotated, the worm shaft is rotated synchronously with the motor, and the rotation is transmitted to each of the worm levers via the worm gear. Accordingly, when the worm lever is rotated forward, each of the throttle valves opens each of the intake passages in correspondence to the rotation of the motor. On the other hand, when the worm lever is rotated backward, each of the throttle valves closes each of the intake passages also in correspondence to the rotation of the motor.

On the other hand, in the fuel injection apparatus for the outboard engine, a vapor separator provided with a high-pressure fuel pump is required. This structure is shown in Japanese Unexamined Patent Publication No. 8-312485.

In accordance with this structure, a fixed liquid level control apparatus constituted by a float, a valve seat and a float valve is arranged within a casing, and fuel supplied from a low-pressure fuel pump forms and holds in a fixed liquid level within the casing by the fixed liquid level control apparatus.

Further, the fuel within the vapor separator is sucked into the high-pressure fuel pump so as to be increased in pressure, and the fuel having the increased pressure is supplied toward the fuel injection valve.

In accordance with the conventional multiple throttle body for the outboard motor mentioned above, since the throttle valve shaft, the throttle lever and the worm lever are required for each of the intake passages, a number of parts and an assembling man-hour are increased, and it is hard to reduce a manufacturing cost.

Further, in the outboard engine, a crank shaft of the engine is generally arranged in a vertical direction with its lengthwise side on the basis of a relation with a screw which is placed in an approximately horizontal direction. Accordingly, a plurality of intake passages are arranged in the vertical direction.

Therefore, the worm shaft is arranged in the vertical direction. In the case that the motor is arranged in an upper end of the worm shaft, the motor protrudes largely to an upper side, a height is increased, and a design freedom of a cowling covering an entire outer periphery of the engine is inhibited.

SUMMARY OF THE INVENTION

A multiple electronic control throttle body for an outboard engine in accordance with the present invention is made by taking the problems mentioned above into consideration. A first object of the present invention is to provide the throttle body which has a reduced number of parts and a reduced number of man-hour and is inexpensive, and a second object of the present invention is to arrange a vapor separator provided with a high-pressure fuel pump and a motor for operating a throttle valve shaft compactly with respect to a throttle body.

In order to achieve the object mentioned above, in accordance with a first aspect of the present invention, there is provided a multiple electronic control throttle body for an outboard engine in which a plurality of intake passages provided in a horizontal direction are arranged in a vertical direction, a throttle valve shaft constituted by one shaft is arranged so as to penetrate each of the intake passages in a vertical direction, and each of the intake passages is opened and closed by each of throttle valves attached to the throttle valve shaft, wherein a motor receiving chamber receiving a motor for operating the throttle valve shaft is formed in an upper end portion of the throttle body and one side of the throttle valve shaft, and a gear receiving chamber receiving a final gear or the like attached to an upper end of the throttle valve shaft is provided in an upper end portion of the throttle body, wherein, a vapor separator, in which a fuel pump is received and a fixed liquid level is formed in an inner portion by a fixed liquid level control apparatus, is arranged in the throttle body in one side of the throttle valve shaft and below the motor receiving chamber, and wherein a pinion gear attached to an output shaft of the motor is engaged with the final gear via an intermediate gear, and an axis of the output shaft of the motor and an axis of the fuel pump are arranged along a longitudinal axis of the throttle valve shaft.

Further, in accordance with a second aspect of the present invention, in addition to the first aspect mentioned above, an opening degree sensor detecting an opening degree of the throttle valve shaft is attached to a cover forming the motor receiving chamber and the gear receiving chamber, and lead wires of the opening sensor, the motor and the fuel pump are arranged toward an upper side.

Further, in accordance with a third aspect of the present invention, in addition to the first aspect mentioned above, the motor receiving chamber and the gear receiving chamber communicates with each other, an atmospheric air open path is connected and opened to a bottom portion of the motor receiving chamber 5, and an unwoven fabric is arranged in the atmospheric air open path.

In accordance with the first aspect of the present invention, a pressure of the fuel within the fuel tank is increased by the low-pressure fuel pump and is supplied into the vapor separator, and the fixed liquid level is always formed and held within the vapor separator by the fixed liquid level control apparatus within the vapor separator.

When the fuel pump is driven, the fuel within the vapor separator is sucked into the fuel pump so as to be increased in pressure, and the fuel having the increased pressure is supplied to the fuel injection valve.

On the other hand, when the motor is driven on the basis of an output signal from an ECU, the rotation of the motor is transmitted to the throttle valve shaft via the pinion gear, the intermediate gear, the final gear, and the throttle valve opens and closes the intake passage by the throttle valve shaft which is rotated in correspondence to the rotation of the motor.

In this case, since the throttle valve shaft is formed by one shaft, and the throttle valve shaft and the output shaft of the motor are engaged by the pinion gear, the intermediate gear and the final gear so as to work with each other, it is possible to reduce the number of the parts and the assembling man-hour, and it is possible to reduce the manufacturing cost of the multiple throttle body.

Owing to the synergistical effect of the structures that the motor receiving chamber receiving the motor is formed in the upper end portion of the throttle body and in one side of the throttle valve shaft, that the gear receiving chamber is formed in the upper end portion of the throttle body, that the vapor separator provided with the fuel pump and the fixed liquid level control apparatus is arranged in the throttle body in one side of the throttle valve shaft and below the motor receiving chamber and that the longitudinal axis of the motor and the longitudinal axis of the fuel pump are arranged along the longitudinal axis of the throttle valve shaft, it is possible to intensively arrange an electronic control portion of the throttle valve in the upper end portion of the throttle body so as to make it compact.

Further, the vapor separator including the motor and the fuel pump can be arranged in one side of the throttle body so as to be close to the throttle valve shaft without expanding largely to the outer side.

Since the vapor separator is arranged close to the throttle body, it is possible to shorten a pipe length of the high-pressure fuel pipe for discharging toward the fuel injection valve from the fuel pump. Accordingly, the structure is preferable particularly in the outboard engine.

Further, in accordance with the second aspect of the present invention, since all of the lead wires of the opening degree sensor, the motor and the fuel pump corresponding to the electric parts of the multiple electronic control throttle body are arranged toward the upper side of the throttle body, it is possible to execute all the electric connections in the upper portion of the throttle body at a time of attaching the throttle body to the outboard engine, so that it is possible to extremely easily execute a connecting work. Further, since water immediately drops down even if the water falls on the outboard engine, and the water is hardly attached to stay in the electric connection portions such as the lead wire, the connector and the like. Accordingly, the structure is preferable.

Further, in accordance with the third aspect of the present invention, when vapor is generated within the motor receiving chamber and the gear receiving chamber due to a temperature change in the chambers, the vapor is discharged to the atmospheric air from the atmospheric air open path via the unwoven fabric, whereby it is possible to inhibit the water drop from being attached to the gear or the motor. On the other hand, when water is poured over the outboard engine, the water may enter into the motor receiving chamber and the gear receiving chamber from the atmospheric air open path. However, the water is inhibited by the unwoven fabric from entering into the chambers.

DESCRIPTION OF THE PREFERRED EMBODIMENT

Figure 1:
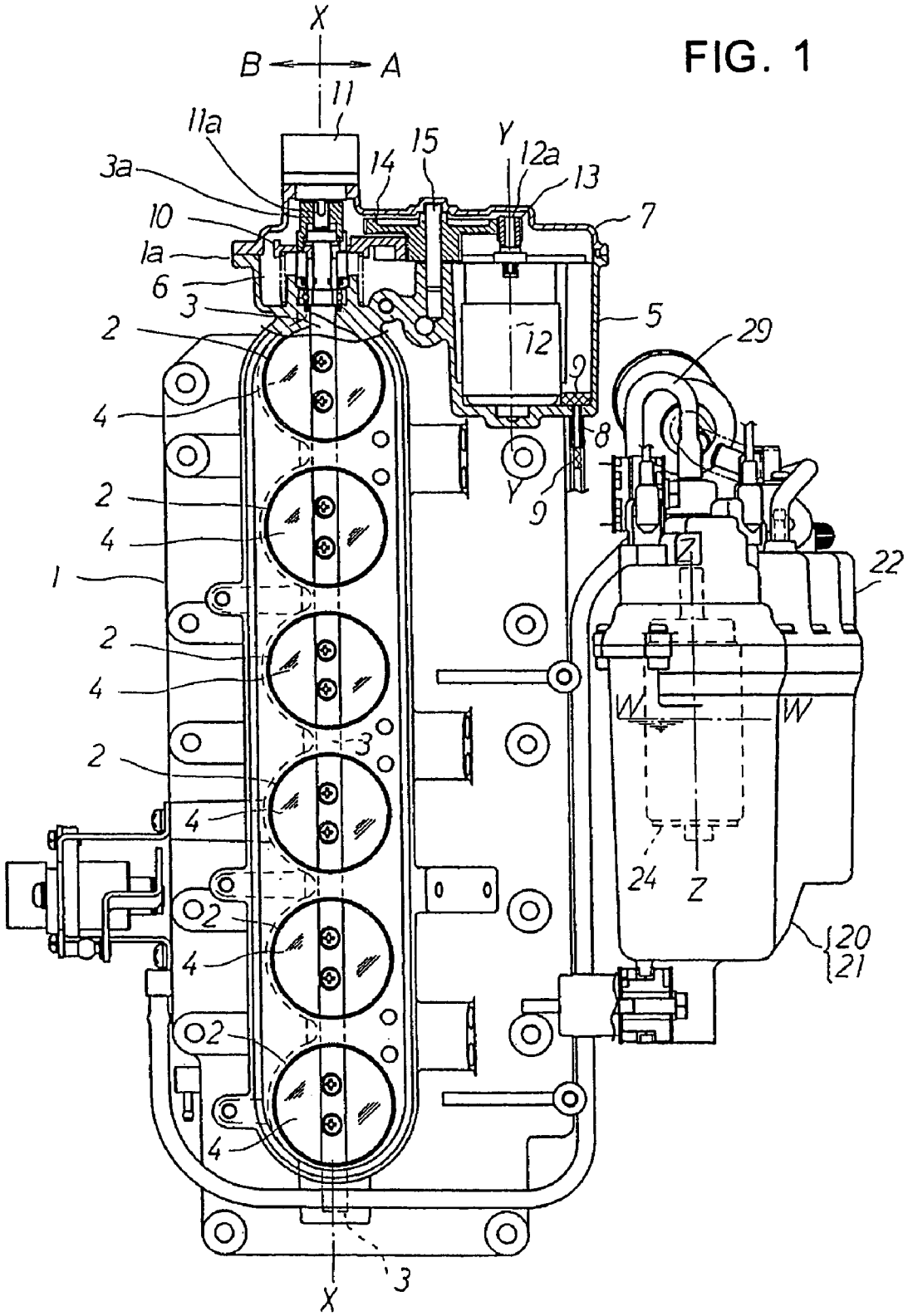
FIG. 1 is a front view showing an embodiment of a multiple electronic control throttle body for an outboard engine in accordance with the present invention.
Figure 2:
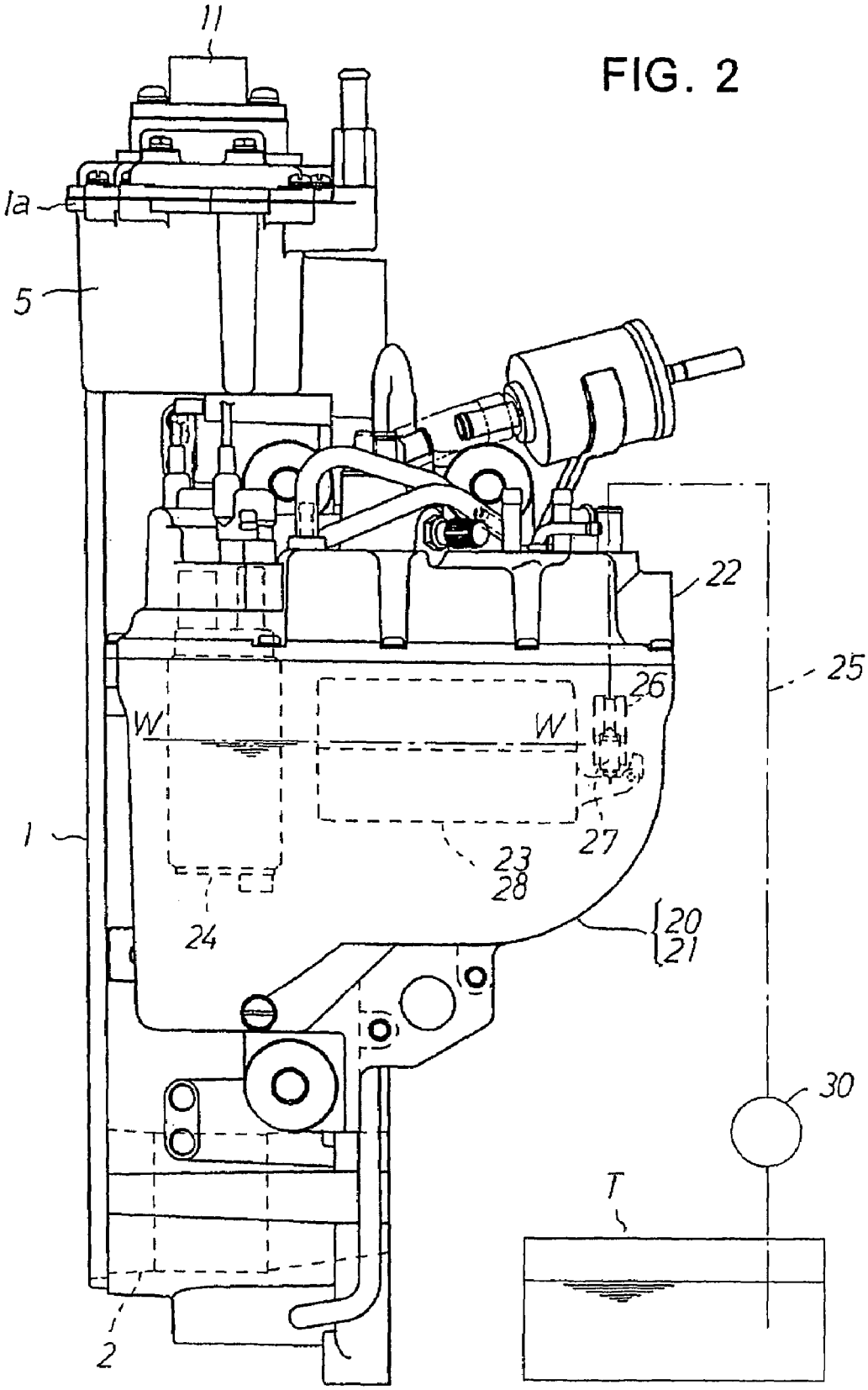
FIG. 2 is a right side view of FIG. 1.

A description will be given below of an embodiment of a multiple electronic control throttle body for an outboard engine in accordance with the present invention with reference to the accompanying drawings.

Reference numeral 1 denotes a throttle body. A plurality of intake passages 2 provided through in a horizontal direction are arranged in the throttle body 1 in a vertical direction. In the present embodiment, six intake passages 2 are formed in the vertical direction for a V-type six-cylinder engine.

Reference numeral 3 denotes a throttle valve shaft constituted by one shaft. The throttle valve shaft 3 is arranged so as to penetrate each of the intake passages 2 in a vertical direction, and is rotatably supported to the throttle body 1.

A throttle valve 4 is arranged in the throttle valve shaft 3 facing to an inner side of each of the intake passages 2. When the throttle valve shaft 3 is rotated, all the throttle valves 4 are synchronously rotated so as to open and close the respective intake passages 2. Further, a motor receiving chamber 5 and a gear receiving chamber 6 are open toward an upper end portion 1*a* of the throttle body 1, and the opening is closed by a cover 7.

The gear receiving chamber is formed so as to surround an outer periphery of an upper end of the throttle valve shaft 3, and the motor receiving chamber 5 is formed in one side A of the throttle valve shaft 3 (a right side of a longitudinal axis X-X of the throttle valve shaft 3 in FIG. 1).

In this case, the motor receiving chamber 5 is formed in a right side of the gear receiving chamber 6 and communicates with the gear receiving chamber 6.

Further, an atmospheric air open hole 8 is arranged so as to open to a bottom portion 5*a* of the motor receiving chamber 5, and an unwoven fabric 9 is arranged in an opening portion to the bottom portion 5*a* in the atmospheric air open hole 8 or within the atmospheric air open hole 8.

The unwoven fabric 9 is constituted by a dry type unwoven fabric in which a polyester, an acryl, a polypropylene and the other are employed singly or in mixture, a wet type unwoven fabric in which a short fiber such as a polyamide, an acryl, a polyester or the like is dispersed in water and is formed into a web by a paper machine, a spun bond in which a random web of a continuous filament is formed and bonded, and the like. The unwoven fabric 9 has a nature being hard to transmit the water while transmitting the vapor.

Further, a final gear 10 in which a gear is formed on an outer periphery is attached to an upper end of the throttle valve shaft 3 protruding to an inner side of the gear receiving chamber 6, and an opening degree sensor 11 is screwed and fixed to the cover 7.

An output shaft 11*a* of the opening degree sensor is arranged on the same axis as the longitudinal axis X-X of the throttle valve shaft 3, and the output shaft 11*a* is arranged within the locking groove 3*a* of the throttle valve shaft 3 so as to be engaged.

Accordingly, the rotation of the throttle valve shaft 3 is transmitted to the output shaft 11*a* via the locking groove 3*a*, and the throttle valve shaft 3 and the output shaft 11*a* of the opening degree sensor 11 are synchronously rotated, whereby the opening degree sensor 11 can output the opening degree of the throttle valve shaft 3 as an electric signal to an external portion from the lead wire 11*b*.

Further, the lead wire 11*b* is arranged so as to protrude to an upper side of the cover 7.

Figure 3:
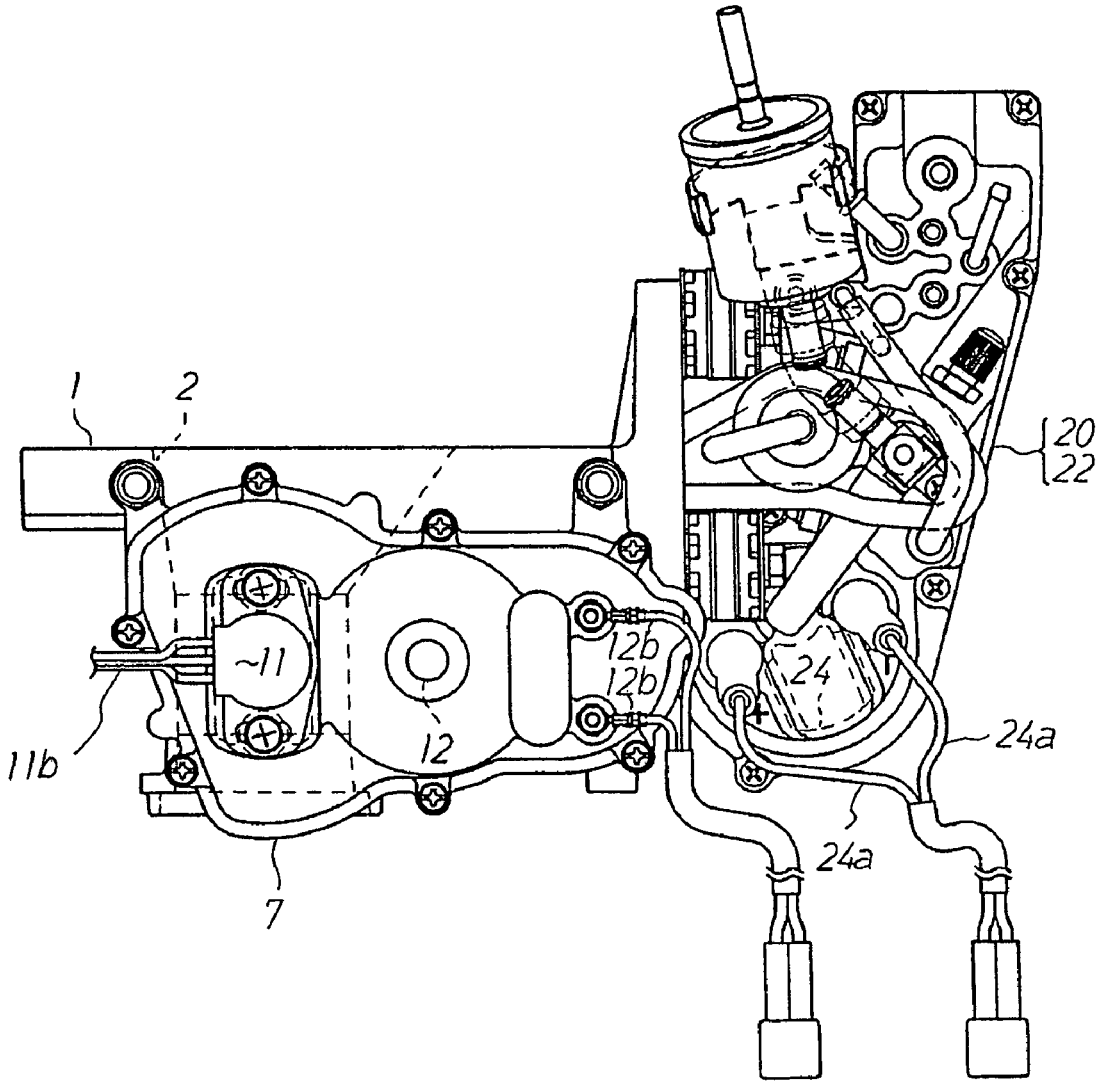
FIG. 3 is a top plan view of FIG. 1.

This structure is well shown in FIG. 3.

A motor 12 for operating the throttle valve shaft is arranged within the motor receiving chamber 5, and a longitudinal axis Y-Y of an output shaft 12*a* of the motor 12 is arranged along the longitudinal axis X-X of the throttle valve shaft 3 (in other words, in parallel).

Further, a pinion gear 13 is attached to an upper end of the output shaft 12*a*, and the pinion gear 13 is engaged with the final gear 10 via an intermediate gear 14.

Accordingly, the rotation of the motor 12 is transmitted to the final gear 10 from the output shaft 12*a* via the pinion gear 13 and the intermediate gear 14, whereby the rotation of the motor 12 is transmitted to the throttle valve shaft 3.

Further, a lead wire 12*b* supplying an electricity to the motor 12 is arranged so as to protrude to an upper side of the cover 7. This structure is well shown in FIG. 3.

In this case, reference numeral 15 denotes an intermediate shaft rotatably supporting the intermediate gear 14.

Reference numeral 20 denotes a vapor separator formed by a casing 21 formed in a closed-end shape and a cover 22 closing the opening thereof. A fixed liquid level control apparatus 23 and an electrically driven fuel pump 24 are arranged in an inner portion of the vapor separator 20.

The fixed liquid level control apparatus 23 is formed by a valve seat 26 arranged in an end portion of a low-pressure fuel passage 25, a float valve 27 opening and closing the valve seat 26, and a float 28 oscillating in correspondence to the liquid level within the vapor separator 20 and moving the float valve 27 in a vertical direction.

Accordingly, when the fuel within the vapor separator 20 is little, the float valve 27 opens the valve seat 26 so as to supply the fuel from the low-pressure fuel passage 25 into the vapor separator 20. As soon as the fixed liquid level W-W is formed within the vapor separator 20, the valve seat 26 is closed by the float valve 27, thereby always forming and holding the fixed fuel liquid level W-W within the vapor separator 20.

In this case, the low-pressure fuel passage communicates with an inner portion of a fuel tank T, the pressure of the fuel within the fuel tank T is increased to a low pressure (for example, 0.3 kg/cm2) by a low-pressure fuel pump 30 such as a diaphragm pump, for example, and the low-pressure fuel is supplied toward the valve seat 26.

The fuel pump 24 is constituted by a wesco type fuel pump, for example, driven by a motor, the fuel pump 24 is arranged so as to be immersed below the fixed liquid level W-W of the vapor separator 20, and a longitudinal axis Z-Z of the fuel pump 24 is arranged along the longitudinal axis X-X of the throttle valve shaft 3.

Further, a lead wire 24*a* supplying electricity to the motor of the fuel pump is arranged so as to protrude to an upper side of the cover 22.

Further, the vapor separator is screwed and fixed to the throttle body 1 in one side A of the throttle valve shaft 3 and below the motor receiving chamber 5.

The multiple electronic control throttle body mentioned above is mounted on the outboard engine. When the outboard engine is started, the fuel pump 24 sucks the fuel within the vapor separator 20 into the pump, and the fuel having the pressure increased by the pump is supplied toward a fuel injection valve (not shown) via the high-pressure fuel pipe 29.

On the other hand, the current is supplied to the motor 12 via an ECU in correspondence to a signal from an accelerator sensor detecting an accelerator opening degree corresponding to a rotating amount of an accelerator grip (not shown), and the motor 12 is driven.

Further, the drive of the motor 12 is transmitted to the throttle valve shaft 3 via the pinion gear 13, the intermediate gear 14 and the final gear 10, and each of the throttle valves 4 controls the opening area of each of the intake passages 2 in correspondence to the rotation of the motor 12, whereby an amount of air flowing toward each of the cylinders of the outboard engine is controlled.

In this case, in accordance with the multiple electronic control throttle body for the outboard engine on the basis of the present invention, since the throttle valve 4 arranged within each of the intake passages 2 is attached to the throttle valve shaft 3 constituted by one shaft, and the final gear 10 attached to the end portion of the throttle valve shaft 3 is arranged so as to be engaged with the pinion gear 13 of the output shaft 12*a* of the motor 12 via the intermediate gear 14, it is possible to reduce the assembling man-hour as well as it is possible to largely reduce the number of the parts, and it is possible to make the structure around the throttle body 1 to be neat as well as it is possible to widely reduce the manufacturing cost.

In particular, since the part such as the lever or the like is not absolutely exposed toward the periphery of the throttle body 1, it is possible to largely improve a corrosion resistance in the structure such as the outboard engine on which sea water, water or the like falls.

Further, since the gear receiving chamber 6 and the motor receiving chamber 5 are formed in the upper end portion 1*a* of the throttle body 1 concentratedly, it is possible to assemble the final gear 10, the intermediate gear 14, the pinion gear 13 and the motor 12 within the chambers from the upper side quickly, and it is possible to improve an assembling property. Further, since the gear receiving chamber 6 and the motor receiving chamber 5 are open upward toward the upper end portion 1*a* of the throttle body 1, it is possible to extremely easily unmold the throttle body 1 toward the upper side at a time of injection molding the throttle body 1.

Further, since the vapor separator 20 is arranged in one side A of the throttle valve shaft 3 and below the motor receiving chamber 5, it is possible to arrange the vapor separator 20 so as to be close to the longitudinal axis X-X of the throttle valve shaft 3 without interfering with the motor receiving chamber 5, and it is possible to compactly arrange the throttle body 1 including the vapor separator 20.

Further, since the longitudinal axis Y-Y of the output shaft 12*a* of the motor 12, and the longitudinal axis Z-Z of the fuel pump 24 are arranged along the longitudinal axis X-X of the throttle valve shaft 3 (in parallel), it is possible to simultaneously solve the durability of the output shaft 12*a* of the motor 12, the throttle valve shaft 3 and the motor shaft of the fuel pump 24, in the structure, to which a particularly great gravitational acceleration is applied during the traveling, such as the outboard engine.

For example, if a vibration preventing countermeasure is applied to a vibration A or B in a horizontal direction with respect to the throttle body 1 in FIG. 1, by using a rubber shock absorbing member or the like, it is possible to simultaneously solve the vibrational proof of the output shaft 12*a* of the motor 12, the throttle valve shaft 3 and the motor shaft of the fuel pump 24 which are arranged in the same direction. This is because the longitudinal axes are arranged in the same direction.

Further, since the lead wire 11*b* of the opening degree sensor 11 and the lead wire 12*b* of the motor 12 are arranged toward the upper side of the cover 7, and the lead wire 24*a* of the fuel pump 24 is arranged toward the upper side of the cover 22, it is possible to execute a connecting work to an external power source simultaneously from the upper side after mounting the throttle body 1 to the outboard engine, whereby it is possible to largely improve a workability.

Further, a connecting terminal between the lead wire and the external power source, and the like are arranged in an upper position. Accordingly, even if sea water or water is poured to this portion, the water drops down immediately and the water is not attached to stay there, so that it is possible to maintain a stable electric connecting property over a long period of time.

Further, since the atmospheric air open hole 8 is open to the bottom portion of the motor receiving chamber 5, and the unwoven fabric 9 is arranged in the atmospheric air open hole 8, the water vapor generated within the motor receiving chamber 5 and the gear receiving chamber 6 is discharged from the atmospheric air open hole 8 via the unwoven fabric 9, whereby it is possible to prevent a corrosion from being generated at a time when the water vapor is condensed and the water drop is attached to the gear and is left for a long period.

On the other hand, there is a case that the periphery of the outboard engine gets wet by spindrift or is washed with water. The unwoven fabric 9 serves for inhibiting the water from entering into the motor receiving chamber 5 at that time.

What is claimed is:

1. A multiple electronic control throttle body for an outboard engine in which a plurality of intake passages provided in a horizontal direction are arranged in a vertical direction, a throttle valve shaft constituted by one shaft is arranged so as to penetrate each of the intake passages in a vertical direction, and each of the intake passages is opened and closed by each of throttle valves attached to the throttle valve shaft, wherein a motor receiving chamber receiving a motor for operating the throttle valve shaft is formed in an upper end portion of the throttle body and one side of the throttle valve shaft, and a gear receiving chamber receiving a final gear attached to an upper end of the throttle valve shaft is provided in an upper end portion of the throttle body, wherein a vapor separator, in which a fuel pump is received and a fixed liquid level is formed in an inner portion by a fixed liquid level control apparatus, is arranged in the throttle body in one side of the throttle valve shaft and below the motor receiving chamber, and wherein a pinion gear attached to an output shaft of said motor is engaged with the final gear via an intermediate gear, and a longitudinal axis of the output shaft of the motor and a longitudinal axis of the fuel pump are arranged along a longitudinal axis of the throttle valve shaft.

2. A multiple electronic control throttle body for an outboard engine as claimed in claim 1, wherein an opening degree sensor detecting an opening degree of the throttle valve shaft is attached to a cover forming said motor receiving chamber and said gear receiving chamber, and lead wires of said opening sensor, said motor and said fuel pump are arranged toward an upper side.

3. A multiple electronic control throttle body for an outboard engine as claimed in claim 1, wherein said motor receiving chamber and the gear receiving chamber communicates with each other, an atmospheric air open path is connected and opened to a bottom portion of the motor receiving chamber, and an unwoven fabric is arranged in said atmospheric air open path.

* * * * *

UNITED STATES PATENT AND TRADEMARK OFFICE

CERTIFICATE OF CORRECTION

PATENT NO. : 7,040,272 B2
APPLICATION NO. : 11/119619
DATED : May 9, 2006
INVENTOR(S) : Kimura et al.

It is certified that error appears in the above-identified patent and that said Letters Patent is hereby corrected as shown below:

On Title Page (item 54) and Column 1, the title should read as follows:

Multiple Intake Arrangement for Electronically Controlled Throttle Valves of an Outboard Engine Signed and Sealed this Twenty-second Day of August, 2006

JON W. DUDAS
*Director of the United States Patent and Trademark Office*